US009624937B2

(12) United States Patent
Makley et al.

(10) Patent No.: US 9,624,937 B2
(45) Date of Patent: Apr. 18, 2017

(54) SAFETY FEATURES FOR MOVING COMPONENTS OF ELECTRONIC DEVICES

(75) Inventors: Albert V. Makley, Morrisville, NC (US); Marc R. Pamley, Durham, NC (US); Daryl Cromer, Cary, NC (US); William F. Keown, Jr., Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 1473 days.

(21) Appl. No.: 12/414,971

(22) Filed: Mar. 31, 2009

(65) Prior Publication Data

US 2010/0244759 A1 Sep. 30, 2010

(51) Int. Cl.
*H02P 1/00* (2006.01)
*F04D 27/00* (2006.01)

(52) U.S. Cl.
CPC ..... *F04D 27/008* (2013.01)

(58) Field of Classification Search
CPC ..... F04D 27/08
USPC ..... 318/268, 273, 278; 700/299, 300; 713/340, 320
See application file for complete search history.

(56) References Cited

U.S. PATENT DOCUMENTS 4,682,769 A * 7/1987 Murakami ..... B65H 3/0669 192/48.3
5,962,933 A * 10/1999 Henderson ..... G06F 21/31 307/116
5,990,582 A * 11/1999 Henderson ..... F04D 29/601 307/130
6,000,623 A * 12/1999 Blatti ..... G06F 1/20 165/80.3
6,247,898 B1 * 6/2001 Henderson ..... G06F 11/3058 165/80.3
6,272,016 B1 * 8/2001 Matonis ..... H05K 7/206 165/80.3
6,275,945 B1 * 8/2001 Tsuji ..... G06F 1/203 361/679.4
6,375,440 B2 * 4/2002 Kosugi ..... F04D 25/166 165/80.3
6,526,333 B1 * 2/2003 Henderson ..... G06F 1/20 361/695
6,556,438 B1 * 4/2003 Bolognia ..... H05K 7/20727 361/679.48
6,721,885 B1 * 4/2004 Freeman ..... G06F 9/4401 713/100
6,771,499 B2 * 8/2004 Crippen ..... G06F 1/20 16/277
6,996,441 B1 * 2/2006 Tobias ..... G05D 23/1919 165/104.33

(Continued)

*Primary Examiner* — Rita Leykin
(74) *Attorney, Agent, or Firm* — Ference & Associates LLC

(57) ABSTRACT

The invention broadly contemplates a safety arrangement that transitions a moving component, for example a cooling fan housed within a chassis of an electronic device, between a first operating mode or condition and a second operating mode or condition. The first operating mode is a normal operating mode, allowing the component (fan) to operate (rotate) at full speed. The second operating mode is a safety or service mode, allowing the component (fan) to operate (rotate) at a reduced speed such that it is compliant with applicable safety regulations.

20 Claims, 5 Drawing Sheets

(56) References Cited

U.S. PATENT DOCUMENTS

| | | | | |
|---|---|---|---|---|
| 7,012,815 | B2 * | 3/2006 | Garnett | G06F 1/183 361/679.31 |
| 7,254,016 | B1 * | 8/2007 | Strickland | G06F 1/3203 361/679.31 |
| 7,307,836 | B2 * | 12/2007 | Scicluna | G11B 33/10 340/635 |
| 7,444,554 | B2 * | 10/2008 | Hori | G06F 1/20 714/1 |
| 7,558,031 | B2 * | 7/2009 | Boren | H02H 7/0833 361/23 |
| 7,688,851 | B2 * | 3/2010 | Cromer | G06F 13/24 370/466 |
| 7,751,186 | B2 * | 7/2010 | Moss | G06F 1/20 312/223.2 |
| 7,862,410 | B2 * | 1/2011 | McMahan | H05K 7/20736 454/184 |
| 8,491,683 | B1 * | 7/2013 | Brown-Fitzpatrick | B03C 3/68 55/283 |

* cited by examiner

SAFETY FEATURES FOR MOVING COMPONENTS OF ELECTRONIC DEVICES

FIELD OF THE INVENTION

This invention is directed to safety features for moving components of electronic devices. Specifically, this invention is directed to cover switch and service mode safety features.

BACKGROUND OF THE INVENTION

All electrical and electronic products sold in markets around the world must demonstrate that they function according to existing safety regulations and standards, as implemented in safety laws and codes. One area of safety regulation involves moving components of electronic devices. Moving components of electronic device must comply with safety regulations, for example safety standard IEC60950-1, incorporated by reference here.

Many electronic devices contain heat-generating components that require cooling. A variety of cooling solutions are employed to regulate the thermal environment of electronic devices. For example, electronic devices such as computers (e.g. desktops, laptops, workstations, etc.) employ heat sinks and/or cooling fans in order to cool specific heat generating components (e.g. a central processing unit, CPU) and to cool the overall device. Without such cooling, the electronic device and its components can overheat and be damaged.

A commonly employed cooling solution in electronic devices is provisioning of airflow by one or more fans, providing thermal regulation to the device and specific heat generating components of the electronic device. Fans generate the airflow required for cooling by rotating at a sufficient speed (peripheral blade speed).

When a fan is used in an electronic device, in addition to accomplishing the cooling job, it must also be configured to protect people from harm. Accordingly, all electronic device fans must demonstrate that they function according to existing safety regulations. The regulations vary based on geographic location, with different degrees of complexity. Accepted safety standards (i.e. IEC60950-1) currently require that fans with (peripheral blade) speeds over a certain predetermined limit (e.g. 15 meters/second (m/s)) have safety features.

Conventional safety features ensuring safety regulation compliance include a safety (finger) guard; reduced fan speeds; and use of specialized materials. However, each of these conventional safety features has significant drawbacks. Safety guards negatively impact thermal and acoustic performance characteristics of the fan. Reduced fan speeds have an obvious negative impact on the amount and quality of airflow produced. Finally, a fan fashioned out of a specialized material can be used (e.g. a specific Dshore hardness) but use of such specialized, safety compliant materials results in a much higher cost and is thus a rather unattractive solution.

The safety guard is widely employed yet has significant drawbacks when it comes to fan performance characteristics. For example, safety guards reduce the amount of airflow produced because they interfere with the airflow entering and/or exiting the fan arrangement inlet/exhaust, depending on where the safety guard(s) is placed. Thus, safety guards tend to increase the static pressure and reduce the amount of airflow provided by the fan. Additionally, safety guards are problematic in as much as they tend to create turbulence in the airflow entering and/or exiting the fan arrangement. This turbulence produced by the safety guards creates acoustic disturbances, propagating noise.

Thus, fans need to rotate at a certain speed in order to provide adequate cooling; however, the speeds required to provide adequate cooling in electronic devices often trigger the need for additional safety features, such as safety guards. In turn, the safety guards tend to cause problems such as reducing fan performance (e.g. in terms of airflow and noise production).

Accordingly, a need has arisen for a way to make moving components of electronic devices, such as fans, compliant with commonly accepted safety standards but that does not reduce the component's performance or increase its cost substantially.

SUMMARY OF THE INVENTION

According to one presently preferred embodiment, the instant invention broadly contemplates a safety arrangement that transitions a moving component within an electronic device between a first operating mode or condition and a second operating mode or condition. The first operating mode is a normal operating mode, allowing the component to operate (e.g. rotate) at fall speed. The second operating mode is a safety or service mode, allowing the component to operate (e.g. rotate) at a reduced speed such that it is compliant with applicable safety regulations.

A presently preferred embodiment of the instant invention comprises a fan arrangement for electronic devices that complies with adopted safety guidelines without suffering reduced performance. The fan arrangement includes a cover switch/service mode fan speed safety feature. In a first operating condition (i.e. normal mode), the fan arrangement, which is either unguarded or employs a reduced impedance fan guard arrangement, operates within the case of the electronic device (e.g. within the system case of a computer). In the first operating condition, the fan rotates at a high speed, well in excess of the threshold amount at which safety standards require safety features (e.g. a safety (finger) guard).

An aspect of the invention provides a mechanism to reduce the fan speed to allow for, among other things, safety regulation-compliant servicing. To transition to the second operating condition, the invention employs a switch. The switch can be implemented as a programmable switch and/or a hardware switch. The programmable switch is activated (i.e. switched on or off) by a user interfacing with the electronic device to cause the electronic device to execute a program application that causes the fan rotate at a reduced speed. This application may be implemented as a BIOS set up application or as an application that can be run in the operating system (OS) environment. The hardware implemented (chassis intrusion) switch can also be employed in addition to the programmable switch. Each of these switches operate to ensure that, should the system casing be opened (e.g. for servicing), the fan arrangement transitions into the second operating condition, i.e. the safety/service mode with reduced fan speed.

In summary, one aspect of the invention provides an apparatus comprising: a processor; a rotating component operatively coupled to the processor and housed within a chassis of the apparatus; and at least one switch configured to transition the rotating component from a first operating mode to a second operating mode on opening of the chassis; wherein, the first operating mode comprises an operating mode in which the rotating component rotates above a threshold speed; and wherein the second operating mode comprises an operating mode in which the rotating component rotates below the threshold speed.

Another aspect of the invention provides a method comprising: rotating a component within a chassis of an electronic device in a first operating mode; and transitioning the component from the first operating mode to a second operating mode responsive to activation of at least one switch configured to transition the component on opening of the chassis; wherein the first operating mode comprises an operating mode in which the component rotates above a threshold speed; and wherein the second operating mode comprises an operating mode in which the component rotates below the threshold speed.

A further aspect of the invention provides a tangible program storage device, readable by machine, embodying a program of instructions that when executed by a processor of the machine enable the machine to: rotate a component within a chassis of an electronic device in a first operating mode; and transition the component from the first operating mode to the second operating mode responsive to activation of at least one switch configured to transition the component on opening of the chassis; wherein the first operating mode comprises an operating mode in which the component rotates above a threshold speed; and wherein the second operating mode comprises an operating mode in which the component rotates below the threshold speed.

For a better understanding of the present invention, together with other and further features and advantages thereof, reference is made to the following description, taken in conjunction with the accompanying drawings, and the scope of the invention will be pointed out in the appended claims.

DETAILED DESCRIPTION OF THE PREFERRED EMBODIMENTS

Figure 1:
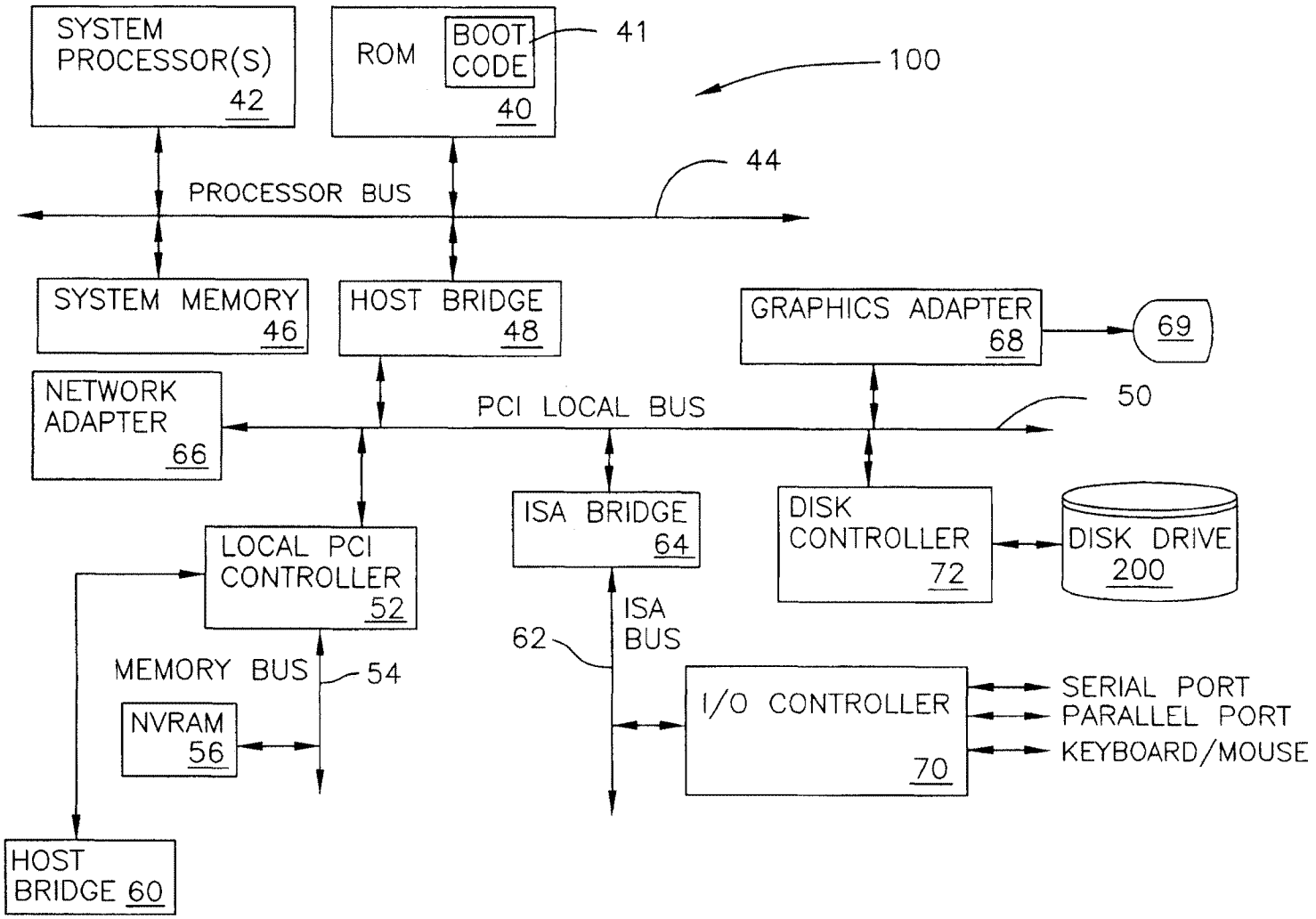
FIG. 1 is a block diagram of an electronic device.

It will be readily understood that the components of the present invention, as generally described and illustrated in the figures herein, may be arranged and designed in a wide variety of different configurations in addition to the described presently preferred embodiments. Thus, the following more detailed description of the embodiments of the present invention, as represented in the figures, is not intended to limit the scope of the invention, as claimed, but is merely representative of selected presently preferred embodiments of the invention.

Reference throughout this specification to "one embodiment" or "an embodiment" (or the like) means that a particular feature, structure, or characteristic described in connection with the embodiment is included in at least one embodiment of the present invention. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings. The following description is intended only by way of example, and simply illustrates certain selected presently preferred embodiments of the invention as claimed herein.

Certified testing facilities (e.g. Technischer Überwachungsverein (TUV) testing facility, see: http://tuvamerica.com/newhome.cfm) ensure that fan arrangements for electronic devices comply with safety standards. For example, safety standard IEC60950-1 requires a safety (finger) guard for fans that have less than 0.5 mm rounded blade edge and greater than 15 m/s peripheral blade velocity. While a safety guard is one way to ensure the safety of users and technicians, the required safety guard set by safety standard IEC60950-1 adds impedance to airflow, which ultimately adds to platform cost and reduces performance. As noted above, safety compliant fan safety guards, because of increases in static pressure and acoustic disturbance, negatively impact fan performance. Additionally, adding a safety guard means adding an additional material component to the fan arrangement, which increases cost.

Accordingly, an embodiment of the invention provides a variable speed fan arrangement that complies with safety standards without reducing fan performance or significantly impacting platform cost. According to one embodiment of the invention, a fan arrangement is configured to selectively operate in first (normal) mode and second (safety or service) mode. In the normal mode, the fan operates at speeds sufficient for optimal cooling of a heat-generating component in an enclosed electronic device. The speeds are in excess of a predetermined (threshold) speed, such as the current IEC60950-1 threshold speed, i.e. 15 m/s peripheral blade velocity.

According to an embodiment of the invention, the fan arrangement is configured to transition from the first mode to the second mode by way of switching. For example, a BIOS or OS program application implemented switch may be used, whereby a user (e.g. a service technician) reduces the speed of the fan by interfacing with the electronic device, via an application program. Another example of a switch is a chassis intrusion switch (e.g. a plunger-type switch), which would ensure that upon case/chassis opening, the fan arrangement is transitioned into the second mode. Thus, an embodiment of the invention ensures the fan will slow to a safety regulation-compliant speed when the system case is opened for servicing without completely powering down the electronic device or the fan arrangement. Reduced fans speed upon case opening are acceptable from a performance standpoint, as the additional ambient cooling provided by the opened case will compensate for the reduced airflow produced by the fan.

According to one embodiment of the invention, the fan is completely unguarded or employs a reduced impedance fan guard arrangement. Because the fan is enclosed in a case of the electronic device, the completely unguarded or reduced impedance fan is compliant with current safety standards, even at higher speeds. Thus, the fan does not require a safety guard. Safety guard (arrangement) is defined herein as a safety guard meeting or exceeding safety regulation IEC60950-1 requirements. Unguarded is defined herein as a fan arrangement without a safety guard; however, an "unguarded" fan may employ a reduced impedance fan guard arrangement, such as a cable guard, that is not compliant with safety regulations. Completely unguarded is defined herein as a fan arrangement with no guard whatsoever, i.e. no safety guard, no reduced impedance fan guard or cable guard, etc.

The choice between a completely unguarded or reduced impedance fan guard to arrangement is essentially a design choice. However, a reduced impedance fan guard is presently preferred as it offers advantages over a completely unguarded fan. For example, a reduced impedance fan guard arrangement acting as a cable guard for ensuring that surrounding cables/wires, etc. do not become entangled with the rotating blades of the fan is presently preferred. However, it should be noted that a completely unguarded fan could be utilized as circumstances permit, as it would still be fully compliant with safety standards because of the mode transitioning. The completely unguarded fan offers maximum performance from the perspective of airflow production and noise reduction, as noted above.

Referring now to FIG. 1, there is depicted a block diagram of an illustrative embodiment of a computer system 100. The illustrative embodiment depicted in FIG. 1 may be a notebook computer system, such as one of the ThinkPad® series of personal computers sold by Lenovo (US) Inc. of Morrisville, N.C. or a workstation computer, such as the Thinkstation®, which is also sold by Lenovo (US) Inc. of Morrisville, N.C. As will become apparent from the following description, however, the present invention is applicable to operation by any data processing system or other electronic device that employs a fan as part of its cooling mechanism (s).

As shown in FIG. 1, computer system 100 includes at least one system processor 42, which is coupled to a Read-Only Memory (ROM) 40 and a system memory 46 by a processor bus 44. System processor 42, which may comprise one of the processors produced by Intel Corporation, is a general-purpose processor that executes boot code 41 stored within ROM 40 at power-on and thereafter processes data under the control of operating system and application software stored in system memory 46. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 100 to LAN 10, and graphics adapter 68, which interfaces computer system 100 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 100 further includes Industry Standard Architecture (ISA) bus 62, which is coupled to PCI local bus 50 by ISA bridge 64. Coupled to ISA bus 62 is an input/output (I/O) controller 70, which controls communication between computer system 100 and attached peripheral devices such as a keyboard, mouse, and a disk drive. In addition, I/O controller 70 supports external communication by computer system 100 via serial and parallel ports. The USB Bus and USB Controller (not shown) are part of the Local PCI controller (52).

Figure 2:
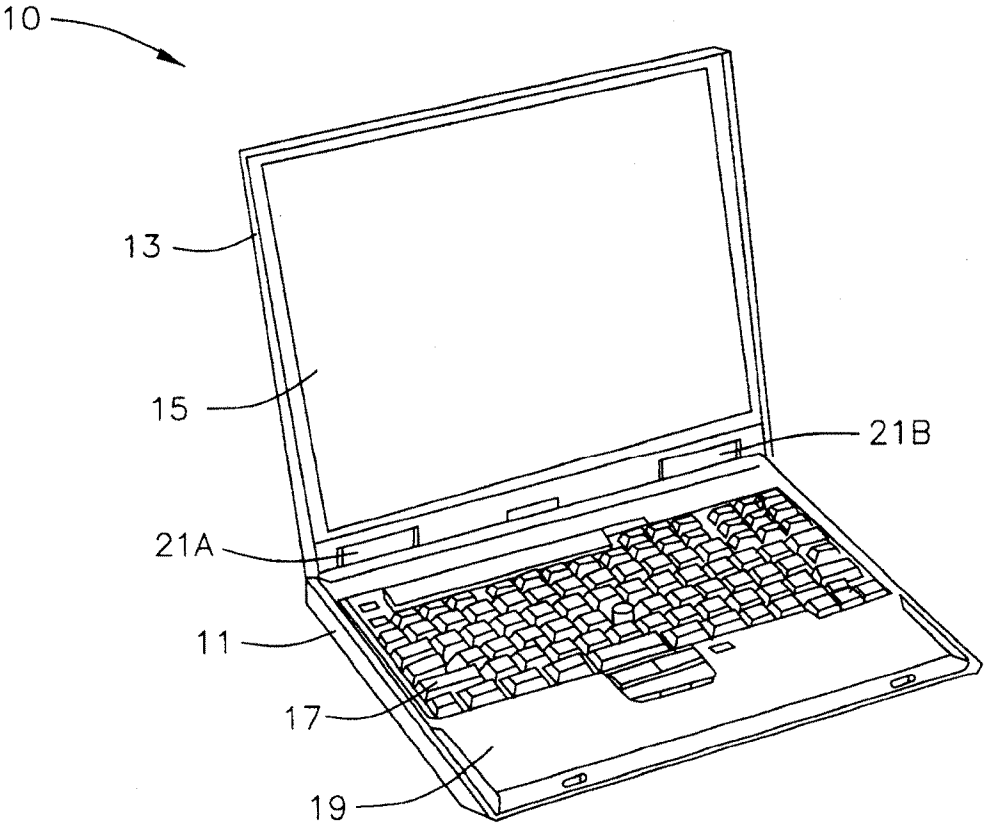
FIG. 2 shows a high level view of an electronic device.

FIG. 2 depicts a high level view of a non-limiting and exemplary electronic device (10), a laptop personal computer (PC) in this example, in which it may be desirable to provide the completely unguarded or reduced impedance fan guard arrangement (not shown). Although a laptop PC is depicted here, as noted above the present invention may be implemented in any number of electronic devices, such as a desktop computer, a workstation computer, a printer, etc. The laptop PC (10) contains a display casing (13) having a display medium (15) therein. The display casing (13) is connected via hinges (21*a*, 21*b*) to a system casing (chassis) (11) of the laptop PC (10). The system casing (chassis) (11) has a palm rest (19), keyboard (17), and contains a fan arrangement (not shown) for providing thermal regulation to the many other functional components of the device (such as those described in conjunction with FIG. 1).

Figure 3:
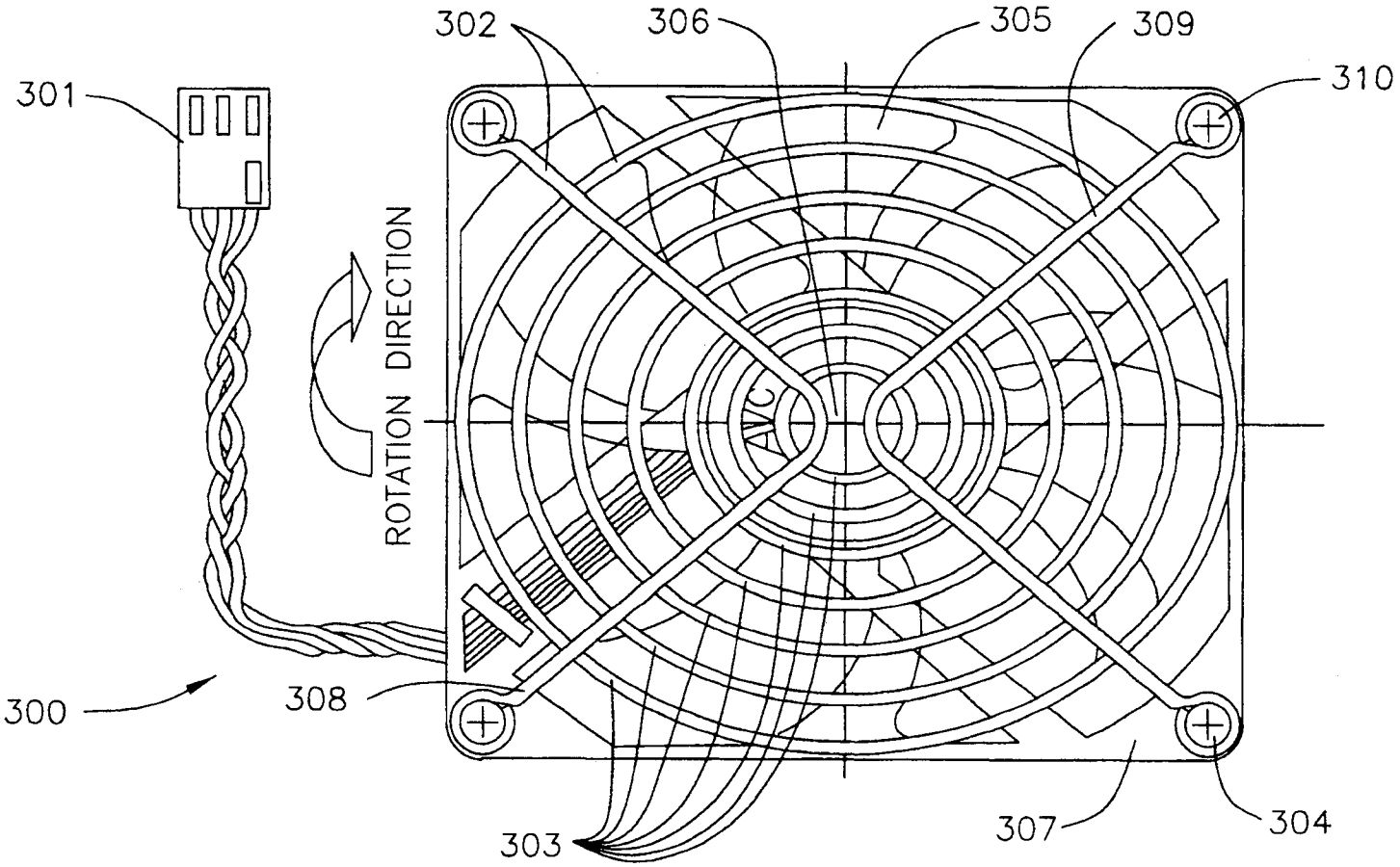
FIG. 3 shows a fan arrangement with a safety guard.

FIG. 3 shows an exemplary, safety regulation (i.e. IEC60950-1) compliant, fan arrangement (300), as discussed above. The fan arrangement (300) may be implemented in any suitable electronic device, such as the electronic device (IO) (laptop PC) depicted in FIG. 2. The fan arrangement (300) is connected to a power source and control circuitry via connection (301). The main body (307) of the fan arrangement (300) encloses an electric powered fan (306). A plurality of baldes (e.g. blade (305)) rotate about the central portion of the fan (306). A safety guard arrangement (302) is depicted, secured to the main body (307) of the fan arrangement (300) in a suitable manner (e.g. via screw(s) (304)).

The safety guard arrangement (302) can be any of several varieties that are compliant with safety regulations. For example, the safety guard arrangement (302) depicted comprises seven (7) rings (303) separated by an approved distance, i.e. designed to prevent insertion of a finger through the safety guard arrangement (302). The safety guard arrangement also includes cross bars (308, 309) that extend from the screws (e.g. 304) and curve at the central portion of the fan and return to another screw (e.g. 310). As above, the safety guard arrangement (302) provides excellent protection from a safety standpoint, but also causes performance problems. The safety guard arrangement (302) impedes airflow into (or exiting) the fan arrangement (300) and produces a turbulent airflow, creating an acoustic disturbance. Moreover, the safety guard contains many rings (303) and crossbars (308, 309), which add cost.

Figure 4:
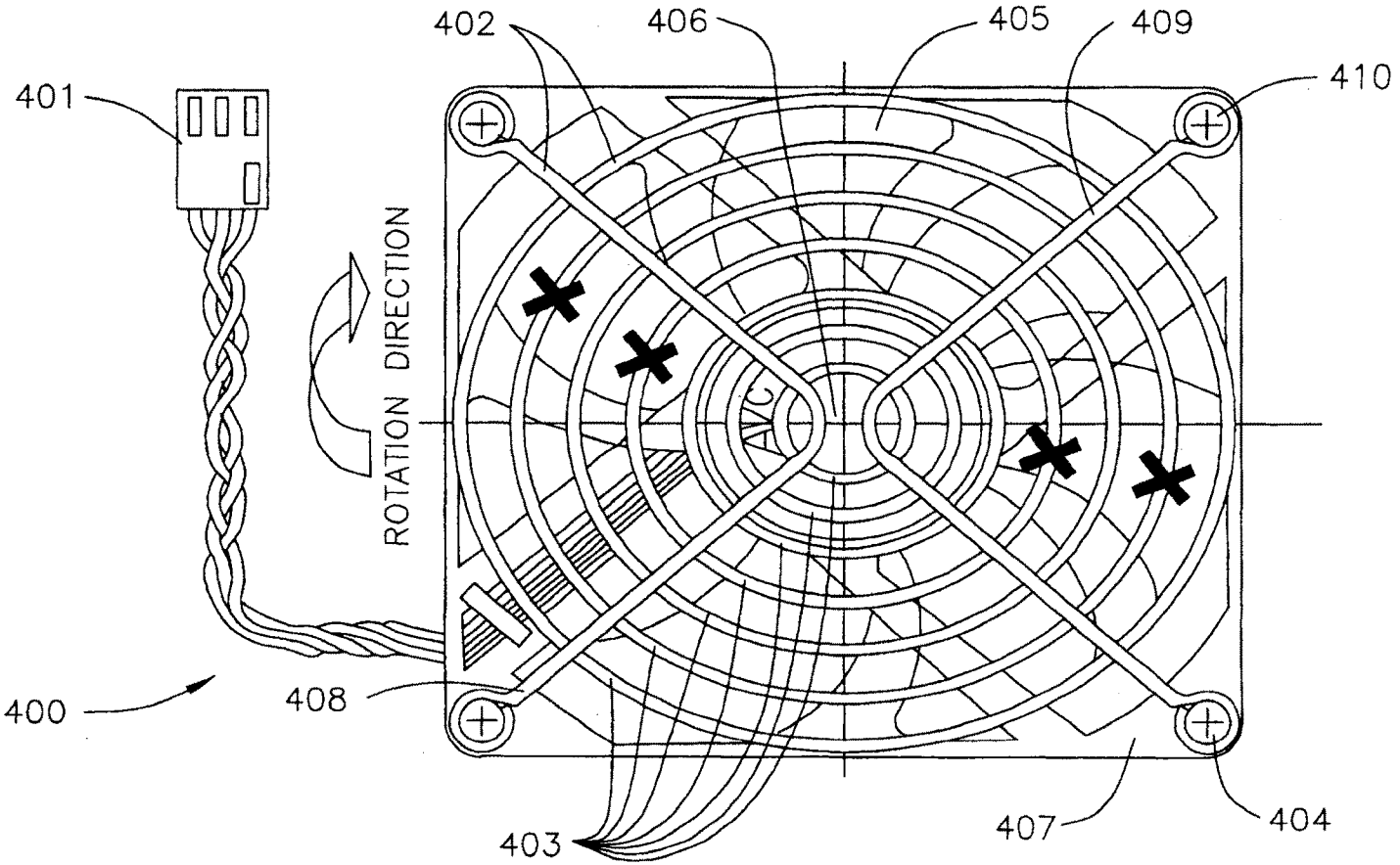
FIG. 4 shows a fan arrangement with a reduced impedance fan guard.

FIG. 4 shows a non-limiting and exemplary fan arrangement (400) according to one presently preferred embodiment of the invention. Again, the fan arrangement (400) is connected to a power source and control circuitry via connection (401). The main body (407) of the fan arrangement (400) encloses an electric powered fan (406). A plurality of baldes (405) rotate about the central portion of the fan (406). A reduced impedance fan guard arrangement (402) is depicted, secured to the main body of the fan arrangement (407) in a suitable manner (e.g. via screw(s) (404)).

In contrast to the safety guard arrangement (302) shown if FIG. 3, the reduced impedance fan guard arrangement (402) is not in and of itself compliant with safety regulations. That is, above the threshold speed (e.g. 15 m/s) the reduced impedance fan guard arrangement (402) is not compliant with safety regulation IEC60950-1. For example, the reduced impedance fan guard arrangement (402) depicted comprises five (5) rings (403), not seven, separated by a distance larger than approved by safety regulations, i.e. not sufficient to prevent insertion of a finger through the reduced impedance fan guard arrangement (402). The reduced impedance fan guard arrangement (402) omits two of the rings that would be necessary to comply with safety regulations.

The reduced impedance fan guard arrangement (402) also includes cross bars (408, 409) that extend from the screws (e.g. 404) and curve at the central portion of the fan and return to another screw (e.g. 410). In contrast to the safety guard arrangement (302) shown in FIG. 3, the reduced impedance fan guard arrangement (402) provides protection only for preventing surrounding cables and components of the electronic device form becoming entangled in the fan (406). That is, it acts as a cable guard. Thus, the reduced impedance arrangement (402) does not cause performance problems as does the safety guard arrangement (302), depicted in FIG. 3. Thus, the reduced impedance fan guard arrangement (402) does not impede airflow into (or exiting) the fan arrangement (400) or produce a turbulent airflow to the extent that safety guard arrangement (302) does. Thus, the reduced impedance fan guard arrangement (402) increases fan performance when compared with fully compliant safety guard arrangements (e.g. 302).

An embodiment of the instant invention allows for use of a completely unguarded fan arrangement or employment of a reduced impedance fan guard arrangement (402) while maintaining compliance with safety regulations by allowing for transitioning from a normal operating mode to a safety/service mode. The transition accomplishes a reduction in fan speed, i.e. below the threshold speed at which more restrictive safety guard arrangements are required. The reduced fan speed is preferably nominal plus tolerance (e.g. if the threshold safety speed is 15 m/s, and if tolerance of the fan is 1 m/s, then the reduced speed is set to 14 m/s in the safety/service mode).

Figure 5:
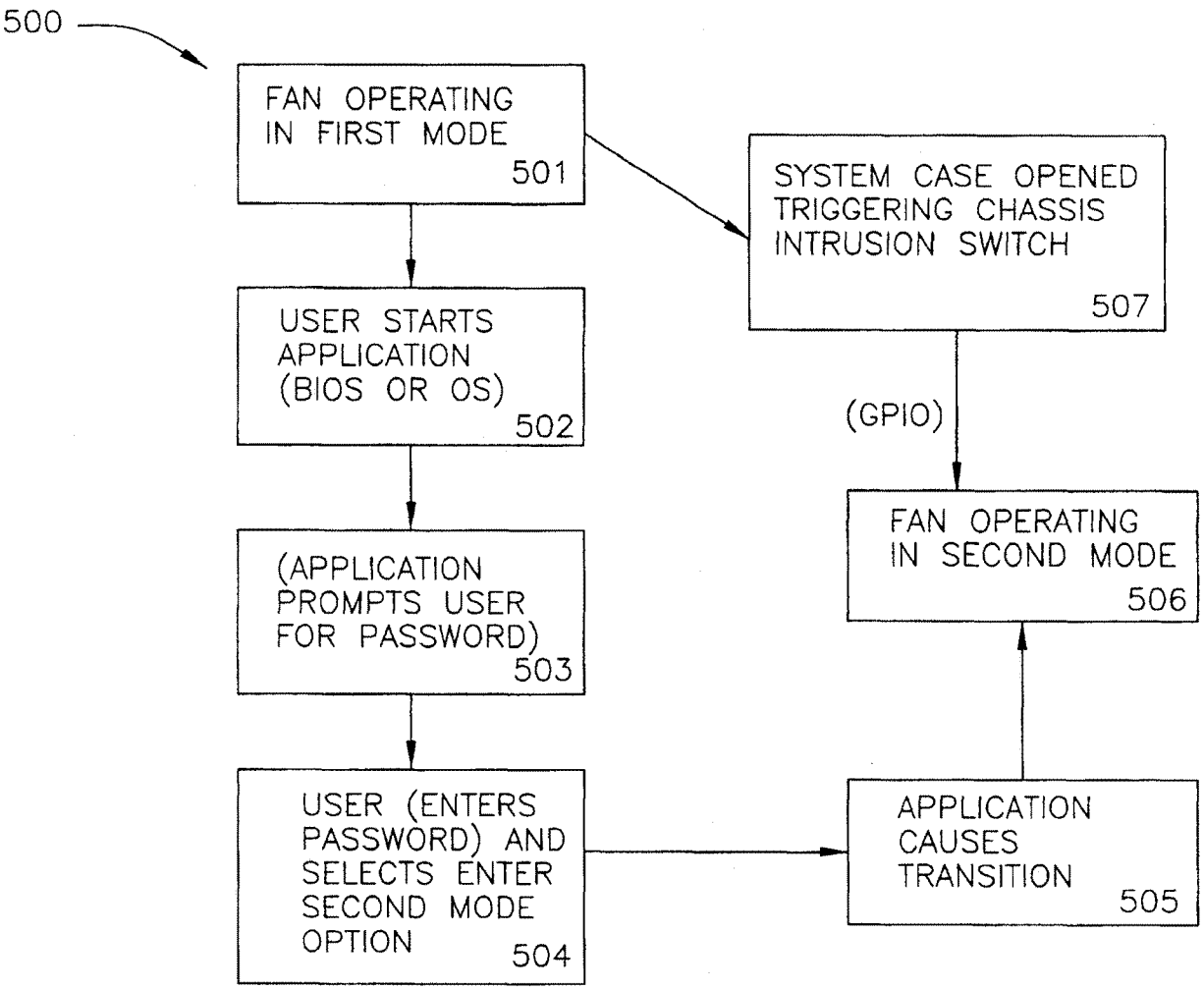
FIG. 5 depicts a flow chart of a method for transitioning the fan between a first mode and a second mode of operation.

FIG. 5 depicts a flow chart of a method (500) for transitioning the fan between a first mode and a second mode of operation. At (501), the fan arrangement (406) operates in a first mode at normal speeds, i.e. speeds optimized for cooling the electronic device and components therein and above the threshold speed set by safety regulations. The unprotected or semi-guarded (i.e. reduced impedance) fan (406) is housed within the system case (19), thus it can operate at speeds well in excess of the threshold speed defined by the applicable safety regulations. However, if a service technician or other user needs access to the internal components of the electronic device, the fan (406) will be exposed upon opening the system case. Consequently, the fan (406) will have to be transitioned to a speed that is compliant with the applicable safety standards, as it does not include a compliant safety guard. The instant invention preferably provides redundant switching mechanisms ensuring compliance.

In a presently preferred mode of operation, the fan (406) operating in the first mode (501) is transitioned by a user starting an application (502) via a graphical user interface (GUI) of the electronic device. The application can be implemented to operate via a BIOS or an OS application (e.g. Windows XP® operating system). The application can optionally be password protected. The nature of the password protection is essentially a design choice depending on the desired level of security/accessibility. It is presently preferred to be at a program level password (i.e. the same password implemented by product) such that an IP administrator can execute the application and have the password for servicing multiple machines.

After the user enters the password (optional), the user selects an option to cause the fan (406) to transition into the second mode (504). After this selection, the application executes (e.g. a processor executes a tangibly stored program of instructions) and transitions the fan to the second operating mode (406), i.e. reduces the speed of the fan to a predefined speed. Thus, the fan (406) transitions to operate in the second mode (506), i.e. the safety/service mode. The predefined speed is selectable, i.e. the application can be configured to implement a fan speed that is appropriate given the applicable safety regulation(s). Presently it is preferred that the fan speed be reduced to a speed that is as high as possible while still complying with the applicable safety regulation(s), within the fan's tolerance. As a non-limiting example, the reduced fan speed is preferably nominal plus tolerance (e.g. if the threshold safety speed is 15 m/s and if tolerance of the fan is 1 m/s, the speed is set to 14 m/s in the safety/service mode) and complies with the IEC60950-1 standard.

Additionally, according to a presently preferred embodiment of the invention, the fan arrangement (400) is supplied with a chassis intrusion switch that is triggered by the opening of the system casing (chassis). It is presently preferred that the chassis intrusion switch is a plunger-type switch, such that a circuit is either completed or interrupted upon the system casing being opened and the plunger switch being moved. Therefore, if the system case is opened, as by a service technician, the chassis intrusion switch will be triggered (507) to GPIO (general purpose input/output) interface and the fan (406) will have its speed reduced according to its second mode of operation (506). The fan (406) will transition back to the first operating mode upon the system casing being closed (i.e. the chassis intrusion switch being restored to its normal position) and the user interfacing with the electronic device to cause the application to restore the first operating mode.

In brief recapitulation, at least one presently preferred embodiment of the invention provides a fan arrangement for electronic devices that complies with adopted safety guidelines without suffering reduced performance. The fan arrangement includes a cover switch/service mode fan speed safety feature. In a first operating condition (i.e. normal mode), the fan arrangement, which is either completely unguarded or employs a reduced impedance fan guard arrangement, operates within the case of the electronic device (e.g. within the system case of a computer). In the first operating condition, the fan rotates at a high speed, well in excess of the threshold amount at which safety standards require safety features (e.g. a safety standard compliant safety (finger) guard). A mechanism reduces the fan speed below the threshold amount in a second operating condition. The invention thus provides mechanisms for ensuring that the fan speed is reduced compliantly upon opening the system case, allowing for safe servicing without powering down the electronic device. This increases the performance characteristics (e.g. airflow and acoustic profiles) of the fan arrangement and reduces overall platform costs.

Many of the functional characteristics of the inventive system described in this specification may be implemented as modules. Modules may include hardware circuits such as one or more processors with memory, programmable logic, and/or discrete components. The hardware circuits may perform hardwired logic functions, execute computer readable programs stored on tangible storage devices, and/or execute programmed functions. The computer readable programs may in combination with a computer system and the other described elements perform the functions of the invention.

It will be readily understood by those having ordinary skill in the art that embodiments of the present invention may take the form of an entirely hardware embodiment or an embodiment containing both hardware and software elements. An embodiment that is implemented in software may include, but is not limited to, firmware, resident software, microcode, etc.

The computer readable programs may be stored in tangible computer/machine-readable (apparatus readable) medium. Examples of a computer/machine-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

Accordingly, elements of the present invention may be implemented on at least one computer running suitable software programs. These may also be implemented on at least one Integrated Circuit or part of at least one Integrated Circuit. Thus, it is to be understood that the invention may be implemented in a combination of both hardware and software. Again, computer/machine-readable programs may in combination with a computer system perform the functions of the invention.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the drawings and specification there has been set forth a preferred embodiment of the invention and, although specific terms are used, the description thus given uses terminology in a generic and descriptive sense only and not for purposes of limitation.

If not otherwise stated herein, it is to be assumed that all patents, patent applications, patent publications and other publications (including web-based publications) mentioned and cited herein are hereby fully incorporated by reference herein as if set forth in their entirety.

What is claimed is:

1. An apparatus comprising:

one or more processors;

a rotating component coupled to the one or more processors and housed within a chassis of the apparatus; and at least one switch configured to transition the rotating component from a first operating mode to a second operating mode responsive to opening the chassis;

wherein the first operating mode comprises an operating mode in which the rotating component rotates above a threshold speed; and wherein the second operating mode comprises an operating mode in which the rotating component actively rotates below the threshold speed.

2. The apparatus according to claim 1, wherein the rotating component comprises a fan having a reduced impedance fan guard arrangement.

3. The apparatus according to claim 1, wherein the rotating component comprises a completely unguarded fan.

4. The apparatus according to claim 1, wherein, in the second operating mode, the rotating component actively rotates at a speed set at nominal plus tolerance.

5. The apparatus according to claim 1, wherein the apparatus comprises an electronic device selected from a desktop computer, a laptop computer; a workstation computer; and a printer.

6. The apparatus according to claim 1, wherein the at least one switch is activated via an operating system application program.

7. The apparatus according to claim 1, wherein the at least one switch is activated via a BIOS application program.

8. The apparatus according to claim 1, wherein the at least one switch comprises a chassis intrusion switch.

9. The apparatus according to claim 8, wherein the at least one switch further comprises a switch activated via an application program.

10. A method comprising:

rotating a component within a chassis of an electronic device in a first operating mode; and transitioning the component from the first operating mode to a second operating mode responsive to activation of at least one switch configured to transition the component responsive to opening the chassis;

wherein the first operating mode comprises an operating mode in which the component rotates above a threshold speed; and wherein the second operating mode comprises an operating mode in which the component actively rotates below the threshold speed.

11. The method according to claim 10, wherein the component comprises a fan having a reduced impedance fan guard arrangement.

12. The method according to claim 10, wherein the component comprises a completely unguarded fan.

13. The method according to claim 10, wherein in the second operating mode, the rotating component actively rotates at a speed set at nominal plus tolerance.

14. The method according to claim 10, wherein the electronic device comprises an electronic device selected from a desktop computer, a laptop computer; a workstation computer; and a printer.

15. The method according to claim 10, wherein the at least one switch is activated via an application program.

16. The method according to claim 15, wherein the application program comprises an operating system application program.

17. The method according to claim 15, wherein the application program comprises a BIOS application program.

18. The method according to claim 10, wherein the at least one switch comprises a chassis intrusion switch.

19. The method according to claim 10, wherein the at least one switch comprises:

a switch activated via an application program; and a chassis intrusion switch.

20. A tangible program storage device, readable by machine, embodying a program of instructions that when executed by a processor of the machine enable the machine to:

rotate a component within a chassis of an electronic device in a first operating mode; and transition the component from the first operating mode to the second operating mode responsive to activation of at least one switch configured to transition the component responsive to opening the chassis;

wherein the first operating mode comprises an operating mode in which the component rotates above a threshold speed; and wherein the second operating mode comprises an operating mode in which the component actively rotates below the threshold speed.

* * * * *